US010260774B2

(12) United States Patent
Deivasigamani et al.

(10) Patent No.: US 10,260,774 B2
(45) Date of Patent: Apr. 16, 2019

(54) LOW PRESSURE DROP WATER HEATING SYSTEM

(71) Applicants: Sridhar Deivasigamani, Peoria, IL (US); Sivaprasad Akasam, Dunlap, IL (US)

(72) Inventors: Sridhar Deivasigamani, Peoria, IL (US); Sivaprasad Akasam, Dunlap, IL (US)

(73) Assignee: Intellihot, Inc., Galesburg, IL (US)

( * ) Notice: Subject to any disclaimer, the term of this patent is extended or adjusted under 35 U.S.C. 154(b) by 371 days.

(21) Appl. No.: 15/161,216

(22) Filed: May 21, 2016

(65) Prior Publication Data

US 2016/0341445 A1 Nov. 24, 2016

Related U.S. Application Data

(60) Provisional application No. 62/164,668, filed on May 21, 2015.

(51) Int. Cl.

| | |
|---|---|
| ***F24H 1/10*** | (2006.01) |
| ***F24H 1/08*** | (2006.01) |
| ***F24D 17/00*** | (2006.01) |
| *F24D 3/10* | (2006.01) |

(52) U.S. Cl.

CPC ..... *F24H 1/10* (2013.01); *F24D 17/0026* (2013.01); *F24H 1/08* (2013.01); *F24D 3/1066* (2013.01); *F24D 3/1091* (2013.01); *F24D 2200/043* (2013.01)

(58) Field of Classification Search

CPC .. F24D 17/0026; F24D 3/1066; F24D 3/1091; F24D 2200/043

USPC ..... 122/235.29

See application file for complete search history.

(56) References Cited

U.S. PATENT DOCUMENTS

| | | | | |
|---|---|---|---|---|
| 2007/0144458 | A1* | 6/2007 | Mukomilow | F24D 3/1066 122/493 |
| 2010/0282440 | A1* | 11/2010 | Trihey | F24D 3/08 165/104.19 |
| 2012/0138149 | A1* | 6/2012 | Hatada | F24H 1/10 137/1 |

* cited by examiner

*Primary Examiner* — Steven B McAllister
*Assistant Examiner* — John Bargero
(74) *Attorney, Agent, or Firm* — Tracy Jong Law Firm; Tracy P. Jong; Cheng Ning Jong

(57) ABSTRACT

A low pressure drop water heating system comprising a cold side conductor having a receiving end and a closed end; a hot side conductor having an exit end and a closed end; a pump; a bypass conductor having a first end and a second end, wherein the first end is adapted to the receiving end and the second end is adapted to the exit end; at least one heat exchanger having a flow valve; a heat exchanger inlet temperature sensor disposed on the inlet of one of the at least one heat exchanger; an outlet temperature sensor disposed at an outlet of the at least one heat exchanger closest to the exit end; a system outlet temperature sensor disposed on the exit end and a system inlet temperature sensor disposed on the receiving end.

18 Claims, 8 Drawing Sheets

LOW PRESSURE DROP WATER HEATING SYSTEM

PRIORITY CLAIM AND RELATED APPLICATIONS

This non-provisional application claims the benefit of priority from provisional application U.S. Ser. No. 62/164,668 filed May 21, 2015. Said application is incorporated by reference in its entirety.

BACKGROUND OF THE INVENTION

1. The Field of the Invention

The present invention is directed generally to a tankless water heating system applicable to a wide variety of applications including high rise buildings or any applications where pressure drop is a critical issue. More specifically, the present invention is directed to a water heating system configured to overcome pressure drop associated with tankless water heating systems.

2. Background Art

High rise buildings are traditionally serviced using tank water heating systems or boiler and tank water heating systems instead of tankless water heating systems due to the pressure require send water to great elevations. Such tank systems are energy inefficient as a large amount of water is prepared ahead of time, prior to the existence of a demand, to anticipate such a demand. While in storage, the thermal energy stored in the heated water is wasted to the tank surroundings even with tank insulation. Previous attempts have been made in the water heating industry to use energy efficient water heating systems to service high rise buildings and other venues requiring increased pump pressure but they have not been successful. Introducing a water heater with a large pressure drop causes the difference in pressure between the hot and cold side to be larger than desired and may cause building water distribution systems to not work properly. However, no previous attempts have been successful in keeping pressure drop low while avoiding the effects of negative pressure while heating water on demand.

Thus, there is a need for a low pressure drop water heating system that does not include a tank water heating system.

SUMMARY OF THE INVENTION

In accordance with the present invention, there is provided a low pressure drop water heating system including a cold side conductor having a receiving end and a closed end; a hot side conductor having an exit end and a closed end; a pump; a bypass conductor having a first end and a second end, wherein the first end of the bypass conductor is fluidly adapted to the receiving end and the second end of the bypass conductor is fluidly adapted to the exit end of the hot side conductor; at least one heat exchanger having a flow valve; a heat exchanger inlet temperature sensor disposed on the inlet of one of the at least one heat exchanger; an outlet temperature sensor disposed at an outlet of the at least one heat exchanger; a system outlet temperature sensor disposed on the exit end of the hot side conductor and a system inlet temperature sensor disposed on the receiving end of the cold side conductor.

The receiving end of the cold side conductor is configured to be connected to a cold water supply manifold. The exit end of the hot side conductor is configured to be connected to a hot water supply manifold. The pump is configured to generate a flow through each of the at least one heat exchanger. When the temperature indicated by the heat exchanger inlet temperature sensor exceeds the temperature indicated by the system inlet temperature sensor, the flow valve of the at least one heat exchanger is configured to be restricted to enable an increased flow from the receiving end of the cold side conductor to the exit end of the hot side conductor through the bypass conductor to temper the water exiting the exit end of the hot side conductor. When the temperature indicated by the system outlet temperature sensor falls below the temperature indicated by the heat exchanger inlet temperature sensor, the flow valve of the at least one heat exchanger is configured to be enlarged to enable an increased flow from the cold side conductor to the exit end of the hot side conductor through the at least one heat exchanger to increase the water temperature exiting the exit end of the hot side conductor.

In one embodiment, the second end of the bypass conductor includes an exhaust having openings which allow effluents from the openings to be pointed in a direction from the exit end of the hot side conductor to the closed end of the hot side conductor 6 or a direction contrary to the flow within the hot side conductor. In one embodiment, the exhaust is an inverted J-shaped exhaust having openings disposed on the upper half of the hot side conductor. In one embodiment, the exhaust further includes an opening allowing effluents from the opening to be pointed in a direction perpendicular to the direction from the exit end of the hot side conductor to the closed end of the hot side conductor 6.

An object of the present invention is to provide an on-demand water heating system capable of servicing customers at significant elevations without significant ill effects due to pressure drop and positive pressure.

Another object of the present invention is to provide an on-demand water heating system to buildings traditionally serviced only using tank water heating systems due to the inability of previously available tankless water heating systems in countering the ill effects of positive pressure.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—low pressure drop tankless water heating system
4—cold side conductor
6—hot side conductor
8—heat exchanger
10—bypass conductor
12—pump
14—exhaust, e.g., J-shaped exhaust
16—aperture
18—exit nozzle of heat exchanger
20—receiving end of cold side conductor
22—exit end of hot side conductor
24—cold water supply manifold
26—hot water supply manifold
28—heat exchanger inlet temperature sensor
30—heat exchanger outlet temperature sensor
32—flow valve
34—high rise building
36—cold water supply into building
38—system inlet temperature sensor
40—system outlet temperature sensor
42—point of use
44—line dividing upper half and lower half of hot side conductor
46—pressure booster pump
48—external recirculation pump
50—check valve
52—external recirculation line
54—pressure regulating valve
56—valve Particular Advantages of the Invention In comparison with tank water heating systems, the present water heating system is significantly more energy efficient as the present water heating system takes advantage of a tankless heating system which only prepares hot water when a demand exists or a short period before a demand exists.

In comparison with previously available tankless water heating systems, the present water heating system is capable of low pressure drop while avoiding positive pressure considered undesirable by users especially at high flowrates.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
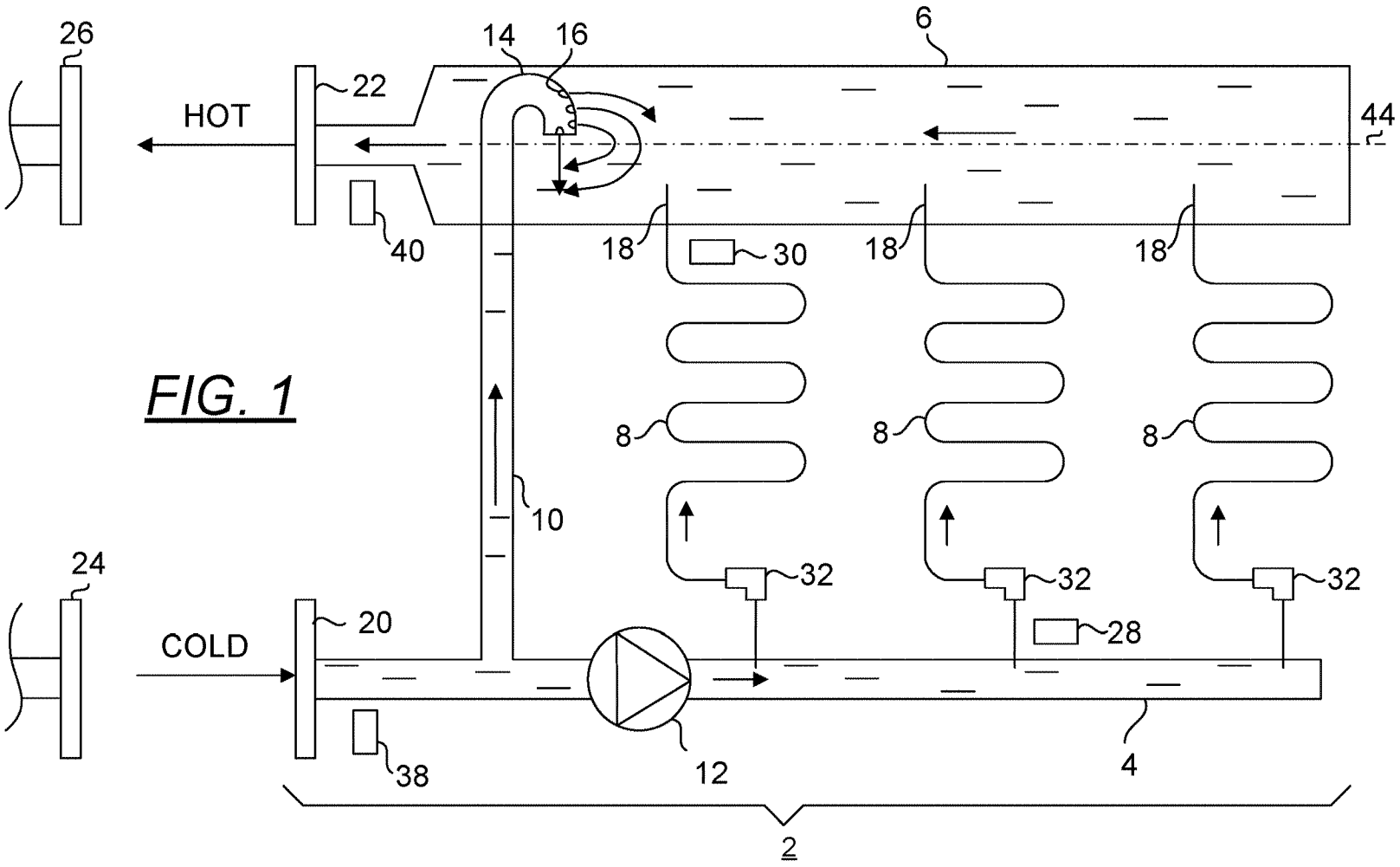
FIG. 1 is a diagram depicting one embodiment of the present low pressure drop water heating system where one or more heat exchangers are used and a forward flow is observed in the bypass conductor.
Figure 2:
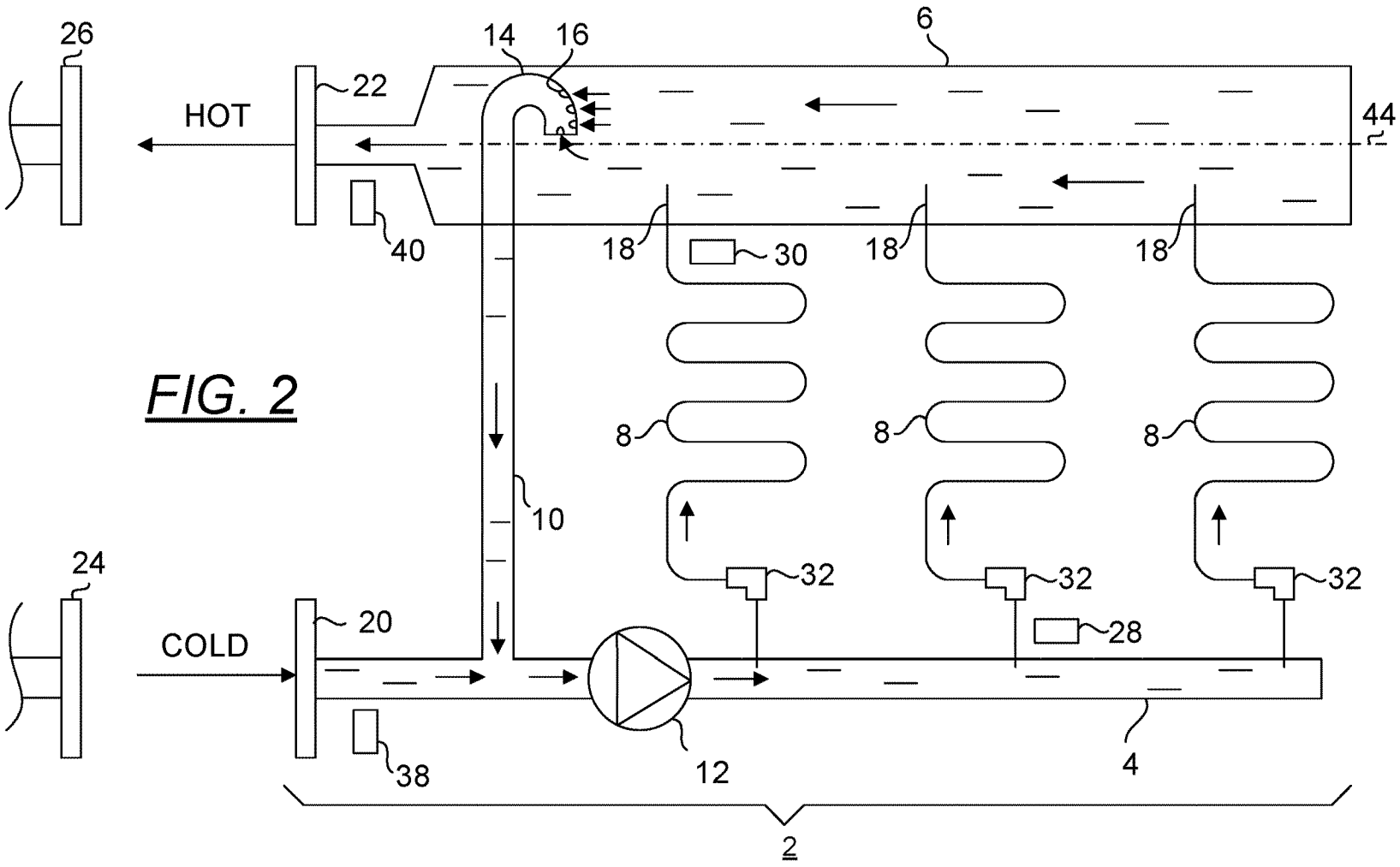
FIG. 2 is a diagram depicting one embodiment of the present low pressure drop water heating system where one or more heat exchangers are used and a recirculation or reverse flow is observed in the bypass conductor.

FIG. 1 is a diagram depicting one embodiment of the present low pressure drop water heating system 2 where one or more heat exchangers 8 are used and a forward flow is observed in the bypass conductor 10. FIG. 2 is a diagram depicting one embodiment of the present low pressure drop water heating system 2 where one or more heat exchangers 8 are used and a recirculation or reverse flow is observed in the bypass conductor 10. Disclosed herein is a low pressure drop water heating system 2 including a cold side conductor 4, a hot side conductor 6, a pump 12, a bypass conductor 10, at least one heat exchanger 8, a heat exchanger inlet temperature sensor 28 disposed on the inlet of one of the three heat exchangers 8, a heat exchanger outlet temperature sensor 30 disposed at an outlet or exit nozzle 18 of one of the three heat exchangers 8, a system outlet temperature sensor 40 disposed on the exit end of the hot side conductor 6 and a system inlet temperature sensor 38 disposed on the receiving end of the cold side conductor 4. Alternatively, each heat exchanger may have its own inlet temperature sensor. However, in this embodiment, only one inlet temperature sensor is used as each heat exchanger experiences a flow originating from a common source. Alternatively, each heat exchanger may also have its own outlet temperature sensor. However, in this embodiment, only one outlet temperature sensor is used as the output flow from each heat exchanger is required to flow past an outlet temperature sensor disposed at the exit nozzle of heat exchanger 8 that is disposed closest to the exit end of hot side conductor 22. The cold side conductor 4 includes a receiving end and a closed end. The hot side conductor 6 includes an exit end and a closed end. In one embodiment, the hot side conductor 6 is configured to hold a volume of water of from about 0.5 to about 2 gallons. In one embodiment, the fluid conductor of a heat exchanger 8 is a tubing having a size of about ¾ inch. The bypass conductor 10 includes a first end and a second end, wherein the first end of the bypass conductor 10 is fluidly adapted to the receiving end of the cold side conductor 4 and the second end of the bypass conductor is fluidly adapted to the exit end of the hot side conductor 6. In one embodiment, the bypass conductor (10) is a tubing having a size of from about 0.5 to about 1.5 inches. Each heat exchanger 8 includes a flow valve 32. The pump 12 increases pressure of water delivered to points of use 42 and negates the pressure drop across heat exchangers 8.

Although, with the positive pressure generated by the pump 12, delivery of water is considered satisfactory for some, for others, the increased pressure may come as a surprise, e.g., when used in a sink or shower. The receiving end 22 of the cold side conductor 4 is configured to be connected to a cold water supply manifold 24 or a port where unheated incoming water is supplied. The exit end 20 of the hot side conductor 6 is configured to be connected to a hot water supply manifold 26 or a port where now heated or hot water is sent out of the water heater and eventually to points of use. The pump 12 is configured to generate a flow through each of the heat exchangers 8. Shown in each of FIGS. 1 and 2 are three heat exchangers 8 although any suitable number of heat exchangers may be used to collectively meet the demand requested through the hot water supply manifold 26 by hot water users.

There are two ways to fundamentally curve shape a pressure drop profile (e.g., Pressure Loss vs. Flow plots). In both case, the system outlet temperature sensor 40 is utilized. A first method involves using a single-speed, less costly, constant speed pump that can create a very large pressure rise at lower flows in place of pump 12. During these lower flows, the flow into one or more of the three heat exchangers 8 is restricted via a flow valve 32. The net result is called "curve shaping" of the pressure drop to mimic the typical pressure drop curve of a tank water heater. A second method involves using a variable speed pump in place of pump 12 to continuously increase speed/pressure from a low to a higher flow, thus again "curve shaping" the pressure drop to mimic pressure drop curve of a tank water heater. In both cases, if a demand is greater than the flowrate the pump 12 can provide to the heat exchangers 8, the required flow is met by increasing the flow via the bypass line, again effecting a low pressure loss.

During a large flow demand jump as typified by the flow configuration shown in FIG. 1, a portion of the cold inlet flow bypasses the heat exchangers 8 and instead flows through the bypass conductor 10 from the cold side conductor 4 to the hot side conductor 6. With the bypass conductor 10, the present water heating system is capable of reducing pressure drop through the heat exchangers 8 by channeling sufficient flow directly through a larger fluid bypass conductor 10 without pressure drop causing equipment, e.g., the rather small fluid conductors of the heat exchangers 8 and flow valves 32, etc., from the cold side conductor 4 to the hot side conductor 6, incurring a significantly lower pressure drop. As the bypass or forward flow is unheated, it is required to be mixed with the heated flow from the heat exchangers 8. When bypass flow occurs from the cold side conductor 4 to the hot side conductor 6, the setpoint temperature of the heat exchangers 8 must be set to a higher value than the desired resultant temperature of the mixed water. For instance, in order to achieve a final delivery temperature of 120 degrees F., the setpoint temperature of the heat exchangers may be set at 140 degrees F. Upon mixing, the water temperature at the exit end 22 of the hot side conductor 6 may approximate 120 degrees F.

When the temperature indicated by the heat exchanger inlet temperature sensor 28 exceeds the temperature indicated by the system inlet temperature sensor 38, the flow valve 32 of at least one of the heat exchangers 8 is configured to be restricted to enable an increased flow from the receiving end of the cold side conductor 4 to the exit end of the hot side conductor 6 through the bypass conductor 10 to temper the water exiting the exit end of the hot side conductor 6. When the temperature indicated by the system outlet temperature sensor 40 falls below the temperature indicated by the heat exchanger inlet temperature sensor 28, the flow valve 32 of at least one of the heat exchangers 8 is configured to be enlarged to enable an increased flow from the cold side conductor 4 to the exit end 22 of the hot side conductor 6 through the heat exchangers 8 to increase the temperature of the water mixture exiting the exit end 22 of the hot side conductor 6, i.e., a higher flowrate of hot water will be produced through the heat exchangers 8 while the cold water flowrate through the bypass conductor 10 is reduced.

If the water temperature indicated by the heat exchanger inlet temperature sensor 28 is higher than temperature as indicated by the system inlet temperature sensor 38, then a recirculation or reverse flow is said to be occurring as the water arriving at the heat exchangers 8 is now disposed at a temperature that is different than the cold water just entering the heating system 2. Referring to FIG. 2, this event occurs when hot water demand decreases to a point where the flow that is caused by the pump 12 through the heat exchangers 8 is now flowing in the direction contrary to the bypass flow. One or more of the flow valves 32 may then be restricted such that the water temperature indicated by the heat exchanger inlet temperature sensor 28 drops to the temperature indicated by the system inlet temperature sensor 38. If the water temperature indicated by the system outlet temperature sensor 40 is below the temperature indicated by the outlet temperature sensor 30, one or more of the flow valves 32 are opened such that less or no cold water will bypass from the cold side conductor 4 to the hot side conductor 6 but a reverse flow will occur in the bypass conductor 10, causing the system outlet temperature sensor 40 to experience a higher temperature. In one embodiment, the second end of the bypass conductor 10 includes an exhaust 14 having openings 16 which allow effluents from the openings to be pointed in a direction from the exit end 22 of the hot side conductor 6 to the closed end of the hot side conductor 6, i.e., a direction contrary to the flow within the hot side conductor. When disposed in such a manner, the exhaust 14 allows the bypass flow to empty into the hot side conductor 6 through the openings 16 in a direction opposite that of the flow from the heat exchangers 8, causing the two flows to sufficiently mix without an active mixer. In one embodiment, the exhaust 14 is an inverted J-shaped exhaust having openings 16 disposed on the upper half of the hot side conductor 6, i.e., above the line 44 dividing upper half and lower half of the hot side conductor 6. As colder water is denser, it tends to drop when exiting the exhaust of the bypass conductor 10, again causing the cold bypass flow to mix favorably and naturally with the hot water of the heat exchangers 8. In another embodiment, the exhaust 14 further includes an opening allowing effluents from the opening to be pointed in a direction perpendicular to the direction from the exit end of the hot side conductor 6 to the closed end of the hot side conductor 6.

Figure 3:
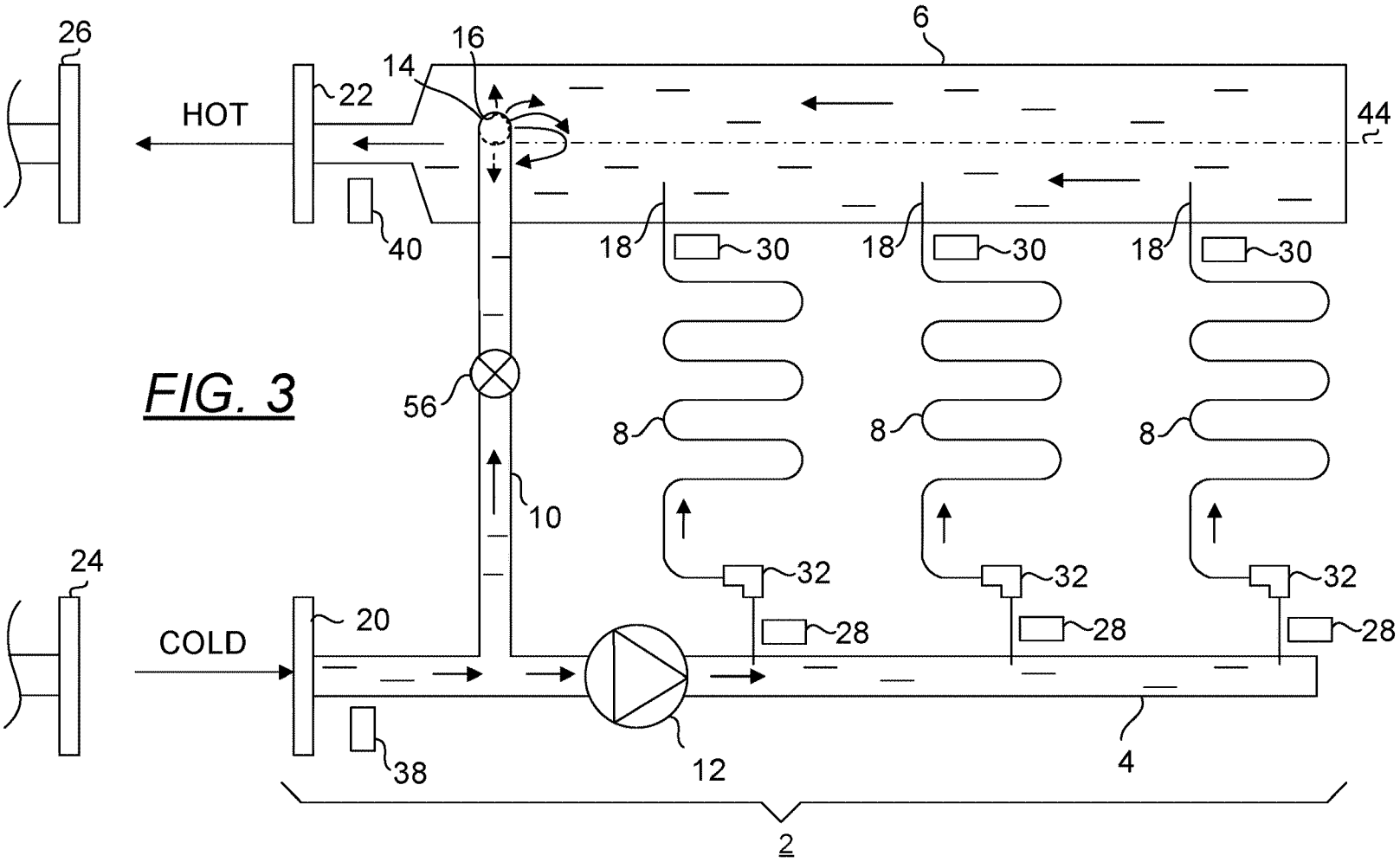
FIG. 3 is a diagram depicting one embodiment of the present low pressure drop water heating system where one or more heat exchangers are used and a forward flow is observed in the bypass conductor.
Figure 4:
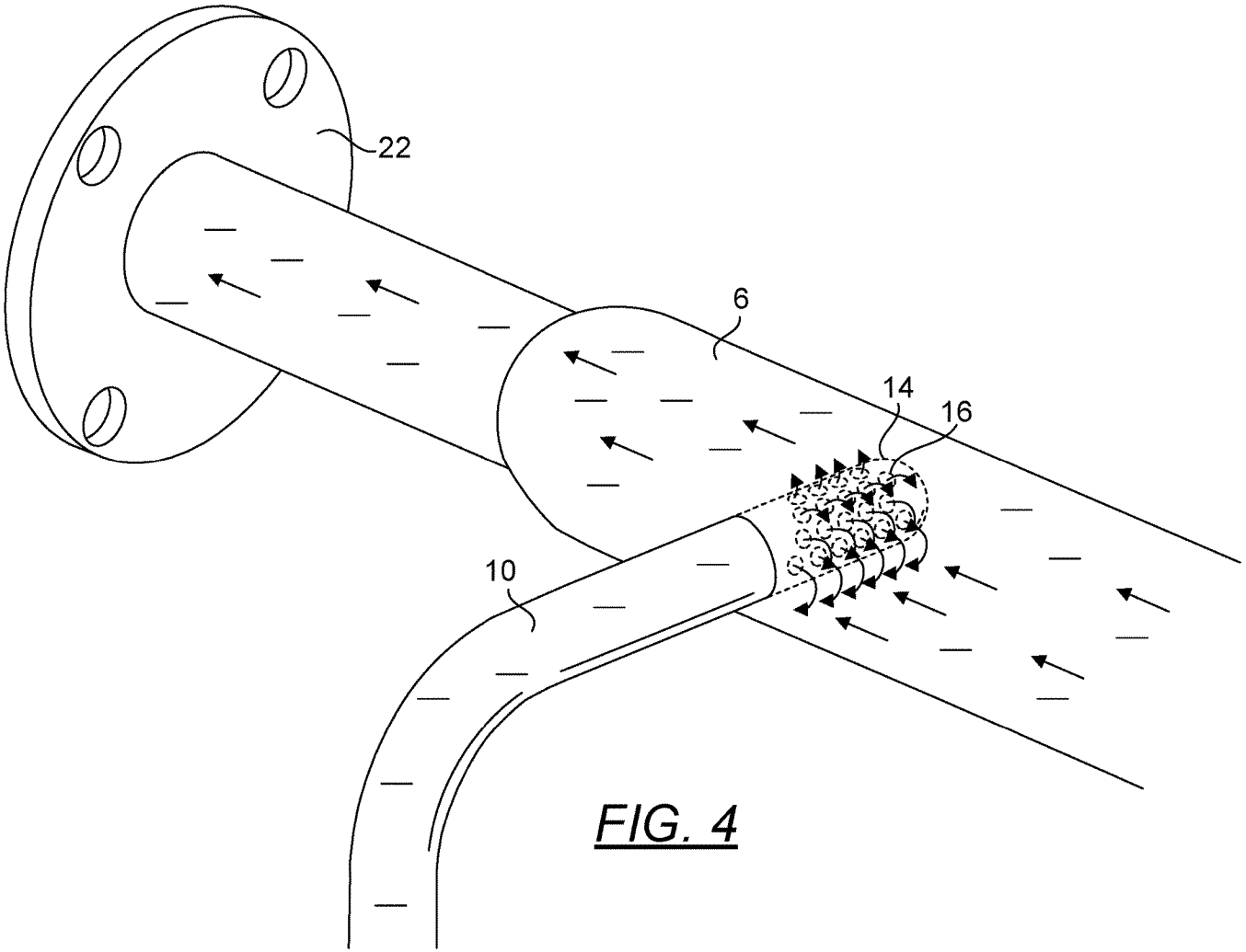
FIG. 4 is a partial transparent view of one embodiment of an exhaust of a bypass conductor of the present low pressure drop water heating system.

FIG. 3 is a diagram depicting one embodiment of the present low pressure drop water heating system where one or more heat exchangers are used and a forward flow is observed in the bypass conductor. In this embodiment, a valve 56 is further provided to control flow through the bypass conductor 10. This valve 56 is normally disposed in the open state, except when two conditions have been encountered. First, if system outlet temperature sensor 40 has been determined to have ceased functioning, e.g., as inferred from a sudden loss of input signals from this sensor, valve 56 is closed to prevent any flow through it. In producing hot water, unheated water is simply received at 20, sent through the cold side conductor 4 before entering the heat exchangers 8 to be heated. Heated water empties into the hot side conductor 6 and proceeds to exit via the hot side conductor 22. Second, if the pump 12 has been determined to have ceased to function, e.g., as inferred from a lower than expected flowrate detected at any one of the flow valves 32, valve 56 is also closed to prevent any flow through it. A failed pump 12 does not prevent a flow that is caused by a hot water demand at one or more points of use. If a pump has been determined to have failed, hot water demand is serviced in the same manner as in the case where the system outlet temperature sensor 40 has failed. A failure can be logged for purposes of problem diagnosis at a later time. It may also be communicated to a service personnel in real time or at a later time. As shown herein, each heat exchanger 8 is equipped with an inlet temperature sensor 28 and an outlet temperature sensor 30. If any one of the inlet temperature sensors fails, at least one of the remaining functional inlet temperature sensors is relied upon until the condition is corrected. If any one of the outlet temperature sensors fails, at least one of the remaining functional outlet temperature sensors is relied upon until the condition is corrected. These limp along modes prevent the need for a complete shutdown of the water heating system such that the water heating system can continue to service points of use until corrective actions can be taken. FIG. 3 also depicts another embodiment of a bypass conductor exhaust 14. In this embodiment, the exhaust is not J-shaped. Instead the exhaust is a straight tube inserted into the hot side conductor 6 through a side wall. FIG. 4 is a partial transparent view of one embodiment of an exhaust of a bypass conductor 10 of the present low pressure drop water heating system. In this embodiment, the exhaust 14 includes more effective openings 16 which allow effluents from the openings to be pointed in a direction from the exit end 22 of the hot side conductor 6 to the closed end of the hot side conductor 6 than openings which allow effluents from the openings to be pointed in a direction from the closed end of the hot side conductor 6 to the exit end 22 of the hot side conductor 6. When disposed in such a manner, the exhaust 14 allows the bypass flow to empty into the hot side conductor 6 through the openings 16 in a direction opposite that of the flow from the heat exchangers 8, causing the two flows to sufficiently mix without an active mixer.

Figure 5:
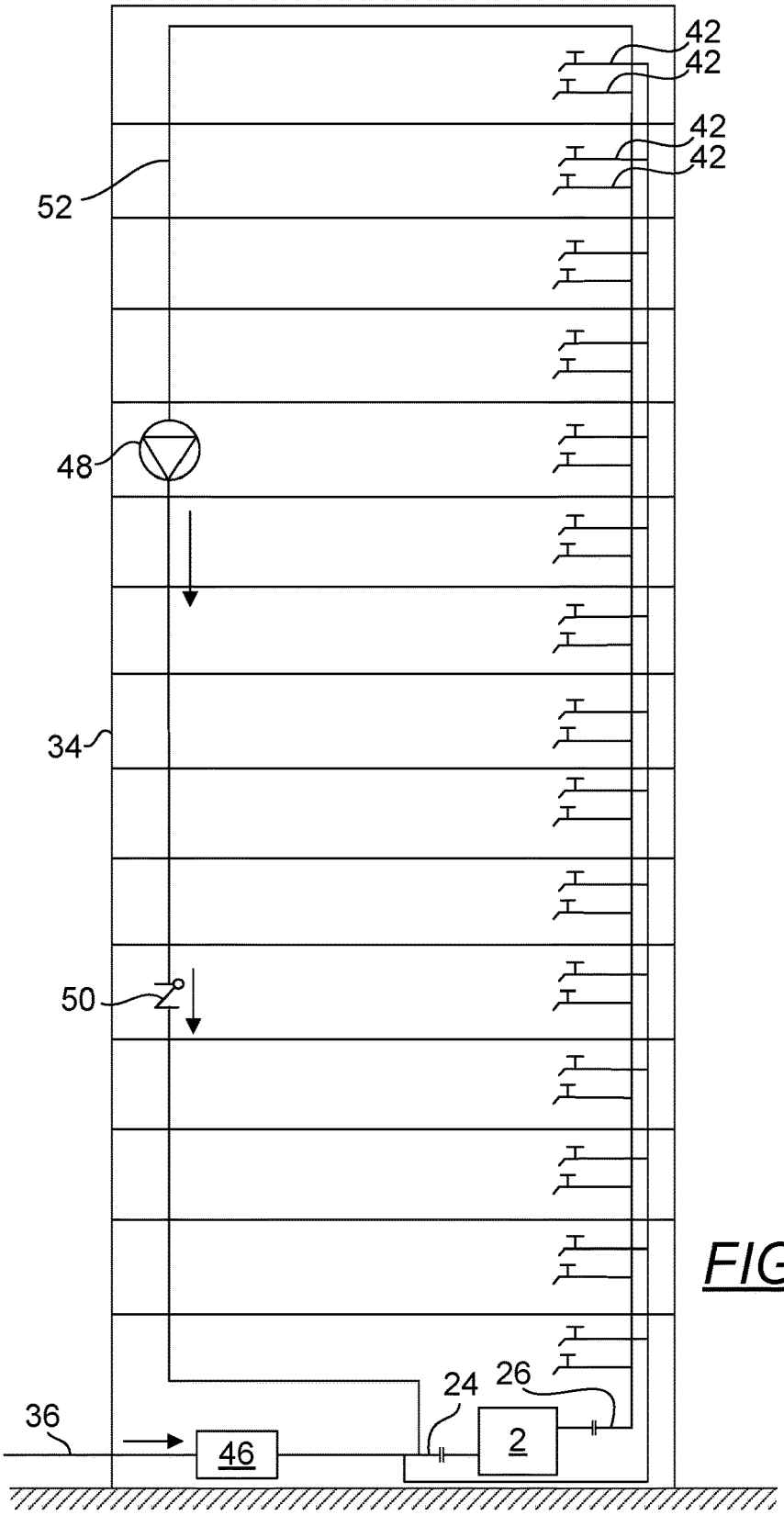
FIG. 5 is a diagram depicting the use of a present low pressure drop water heating system to deliver hot water to a high rise building which has traditionally been serviced using a tank water heating system.
Figure 6:
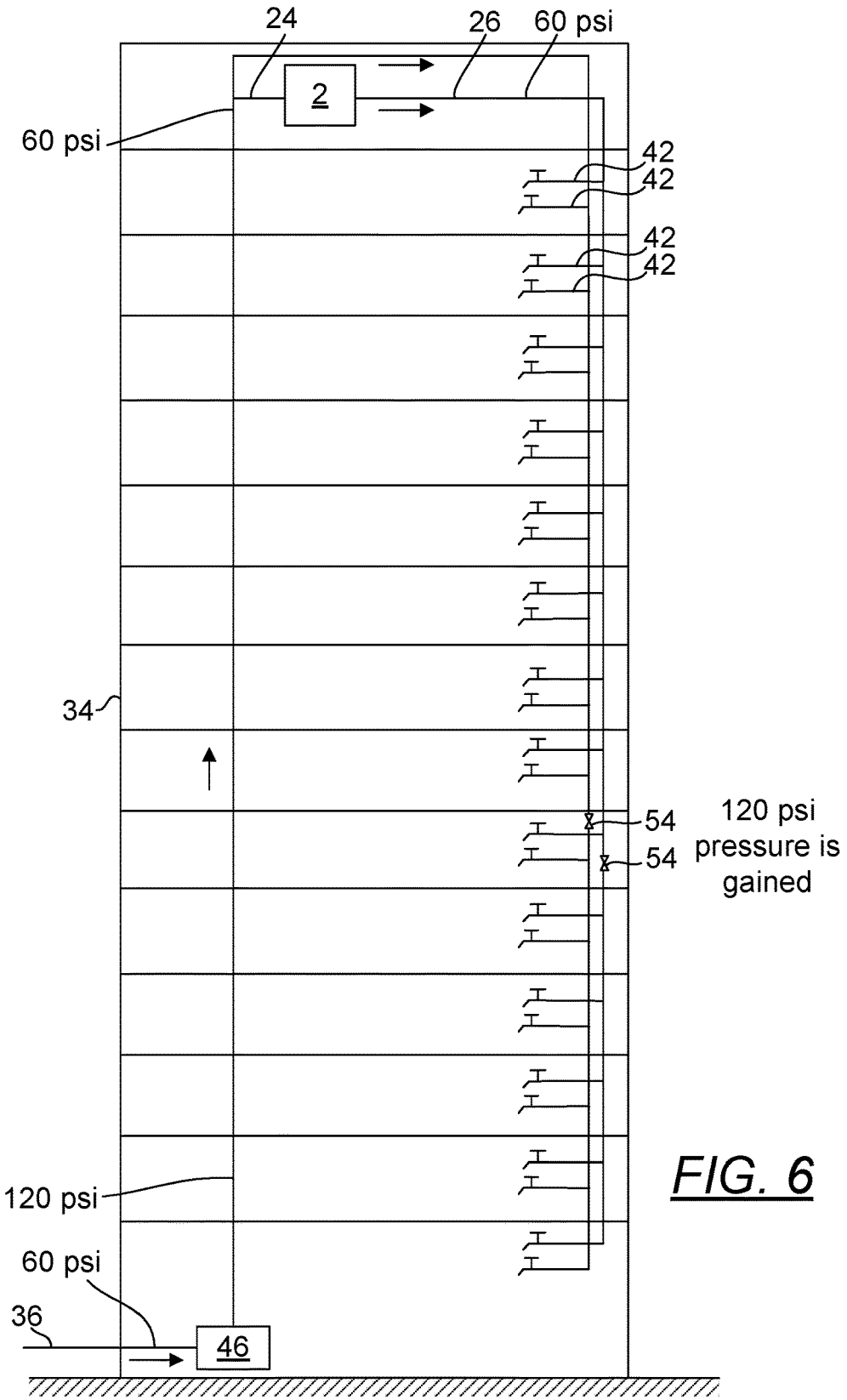
FIG. 6 is another diagram depicting the use of a present low pressure drop water heating system to deliver hot water to a high rise building which has traditionally been serviced using a tank water heating system.

FIG. 5 is a diagram depicting the use of a present low pressure drop water heating system 2 to deliver hot water to a high rise building 34 which has traditionally been serviced using a tank water heating system. Such an application typically involves the aid of a pressure booster pump 46 to deliver both hot and cold water to customers due to insufficient water pressure with simply municipal water supply. The present water heating system is capable of receiving a cold water supply 36, preparing the water to a desired temperature and delivering the prepared water to points of use 42 of a high rise building 34 at multiple floors. FIG. 6 is another diagram depicting the use of a present low pressure drop water heating system 2 to deliver hot water to a high rise building which has traditionally been serviced using a tank water heating system. It shall be noted that the water heating system 2 is mounted at the top of the building 34 instead of the bottom of the building 34. FIG. 6 is another diagram depicting the use of a present low pressure drop water heating system to deliver hot water to a high rise building which has traditionally been serviced using a tank water heating system.

Figure 7:
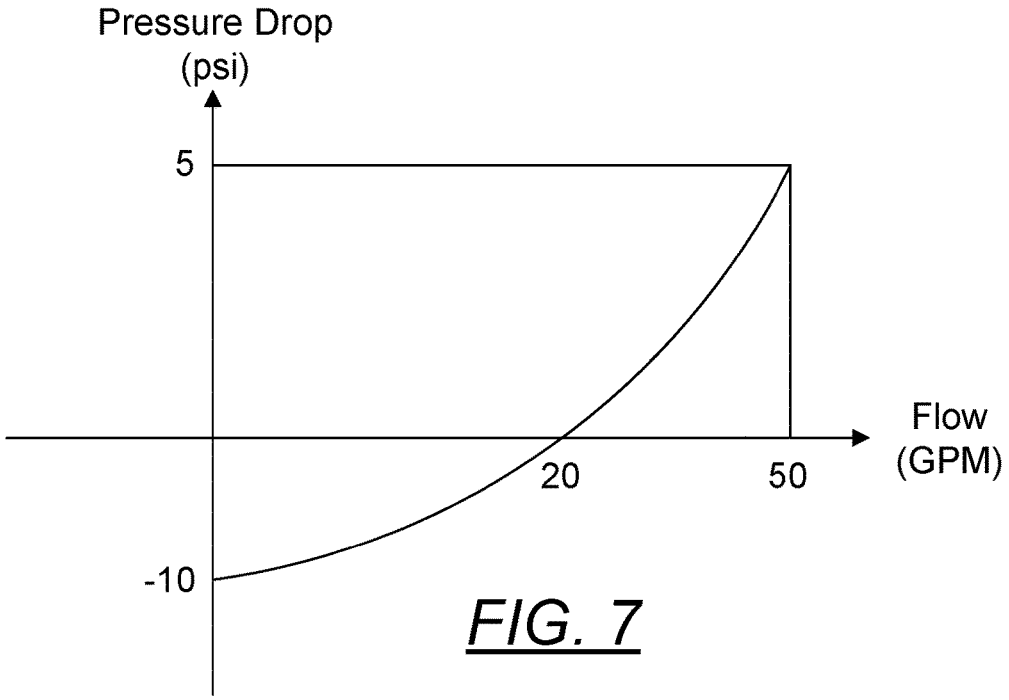
FIG. 7 is a graph depicting an example pressure drop curve in a water heating system using a present water heating system without effecting flow valve control.
Figure 8:
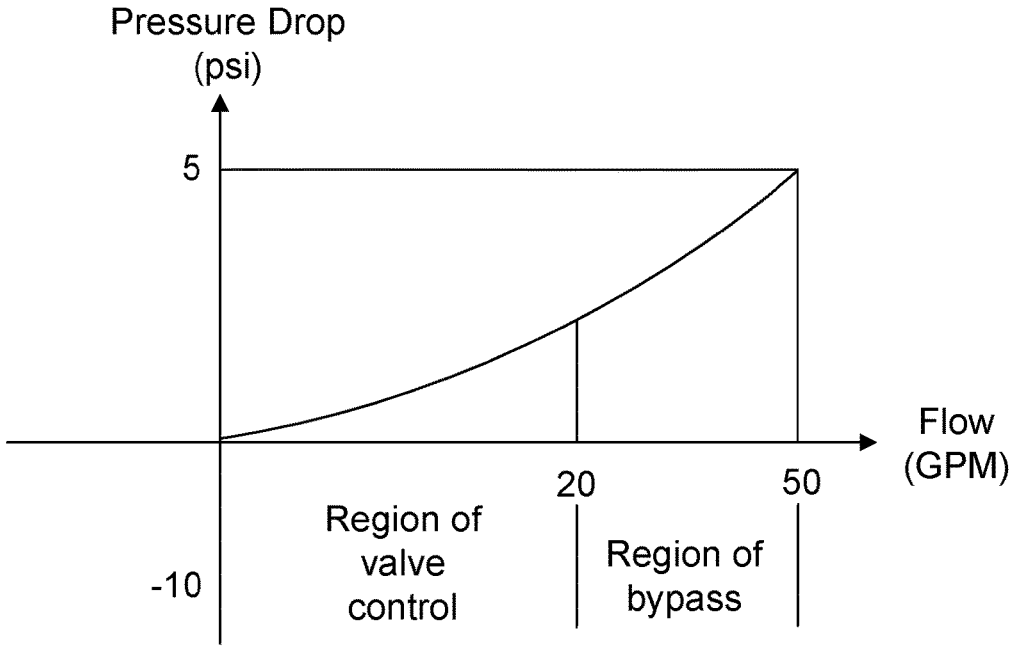
FIG. 8 is a graph depicting an example pressure drop curve of a present low pressure drop water heating system.

FIG. 7 is a graph depicting an example pressure drop curve in a water heating system using a present water heating system without effecting flow valve 32 control. It shall be noted that without flow valve 32 control, during certain low flowrates of up to, e.g., 20 GPM, there is a pressure gain. FIG. 8 is a graph depicting an example pressure drop curve of a present low pressure drop water heating system. It shall be noted that the graph represents a pressure drop-flowrate plot that mimics a tank water heating system, i.e., with suitable pressure drop at larger flowrates.

Figure 9:
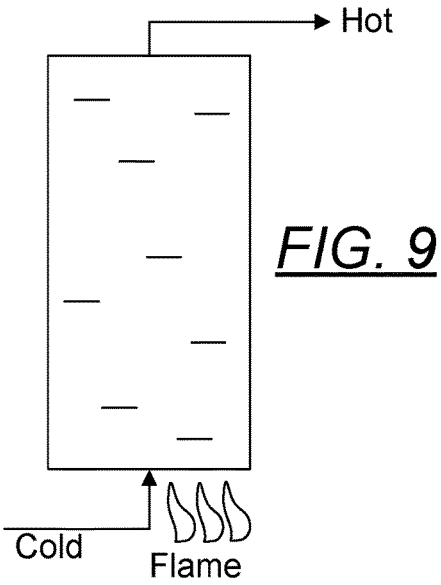
FIG. 9 is a diagram depicting the representation of a conventional or tank water heating system with cold water being received in a large tank and this large volume of water being heated in the large tank.
Figure 10:
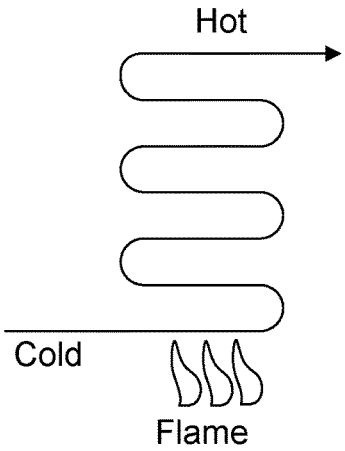
FIG. 10 is a diagram depicting the representation of a heat exchanger element of a present water heating system where hot water is produced as a demand exists and therefore a large tank is not required or desired.
Figure 11:
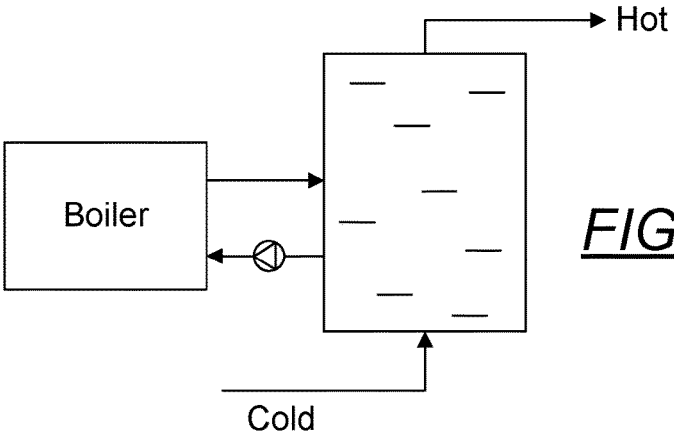
FIG. 11 depicts a typical water heating system with a storage tank and a boiler.

FIG. 9 is a diagram depicting the representation of a conventional or tank water heating system with cold water being received in a large tank and this large volume of water being heated in the large tank. In contrast, FIG. 10 is a diagram depicting the representation of a heat exchanger element of a present water heating system where hot water is produced as a demand exists and therefore a large tank is not required or desired. FIG. 11 is a typical water heating system with a storage tank and a boiler. Note again the use of a large tank as compared to a present water heating system.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A low pressure drop water heating system (2) comprising:

(a) a cold side conductor (4) comprising a receiving end and a closed end;

(b) a hot side conductor (6) comprising an exit end and a closed end;

(c) a pump (12);

(d) a bypass conductor (10) comprising a first end, a second end and an exhaust (14) comprising at least one opening configured for allowing effluents of said at least one opening (16) to be pointed in a direction from said exit end of said hot side conductor (6) to said closed end of said hot side conductor (6), wherein said first end of said bypass conductor (10) is adapted to said receiving end of said cold side conductor (4) and said second end of said bypass conductor (10) is adapted to said exit end of said hot side conductor (6) and said exhaust is disposed within said hot side conductor (6);

(e) at least one heat exchanger (8) comprising a flow valve (32);

(f) an inlet temperature sensor (28) disposed on an inlet of said at least one heat exchanger (8);

(g) an outlet temperature sensor (30) disposed on an outlet of said at least one heat exchanger (8) closest to said exit end of said hot side conductor (6);

(h) a system outlet temperature sensor (40) disposed on said exit end of said hot side conductor (6); and (i) a system inlet temperature sensor (38) disposed on said receiving end of said cold side conductor (4), wherein said receiving end of said cold side conductor (4) is configured to be connected to a cold water supply manifold, said exit end of said hot side conductor (6) is configured to be connected to a hot water supply manifold (26), said pump (12) is configured to generate a flow through each of said at least one heat exchanger (8) and whereby when a temperature indicated by said inlet temperature sensor (28) exceeds a temperature indicated by said system inlet temperature sensor (38), said flow valve (32) of said at least one heat exchanger (8) is configured to be restricted to enable an increased flow from said receiving end of said cold side conductor (4) to said exit end of said hot side conductor (6) through said bypass conductor (10) to temper a flow exiting said exit end of said hot side conductor (6) and when a temperature indicated by said system outlet temperature sensor (40) falls below a temperature indicated by said inlet temperature sensor (28), said flow valve (32) of said at least one heat exchanger (8) is configured to be enlarged to enable an increased flow from said cold side conductor (4) to said exit end of said hot side conductor (6) through said at least one heat exchanger (8) to increase the temperature of the flow exiting said exit end of said hot side conductor (6) and said at least one opening of said exhaust causes said effluents of said at least one opening (16) to be mixed with a flow within said hot side conductor (6) to form the flow exiting said exit end of said hot side conductor (6).

2. The low pressure drop water heating system (2) of claim 1, wherein said hot side conductor (6) further comprises an upper half and a lower half and said exhaust (14) is configured to be disposed on said upper half of said hot side conductor (6).

3. The low pressure drop water heating system (2) of claim 1, wherein said hot side conductor (6) further comprises an upper half and a lower half and said exhaust (14) is an inverted J-shaped exhaust having at least one opening disposed on said upper half of said hot side conductor (6).

4. The low pressure drop water heating system (2) of claim 1, wherein said exhaust (14) further comprises at least one opening configured for allowing effluents of said at least one opening to be pointed in a direction perpendicular to a direction from said exit end of said hot side conductor (6) to said closed end of said hot side conductor (6).

5. The low pressure drop water heating system (2) of claim 1, wherein said hot side conductor (6) further comprises a volume of from about 0.5 to about 2 gallons and said bypass conductor (10) comprises a tubing of size of from about 0.5 to about 1.5 inches.

6. The low pressure drop water heating system (2) of claim 1, further comprising a valve (56) disposed within said bypass conductor (10).

7. A low pressure drop water heating system (2) comprising:

(a) a cold side conductor (4) comprising a receiving end and a closed end;

(b) a hot side conductor (6) comprising an exit end, a closed end and a volume of from about 0.5 to about 2 gallons;

(c) a pump (12);

(d) a bypass conductor (10) comprising a first end, a second end and a tubing of size of from about 0.5 to about 1.5 inches, wherein said first end of said bypass conductor (10) is adapted to said receiving end of said cold side conductor (4) and said second end of said bypass conductor (10) is adapted to said exit end of said hot side conductor (6);

(e) at least one heat exchanger (8) comprising a flow valve (32), an inlet temperature sensor (28) disposed on an inlet of said at least one heat exchanger (8) and an outlet temperature sensor (30) disposed on an outlet of said at least one heat exchanger (8);

(f) a system outlet temperature sensor (40) disposed on said exit end of said hot side conductor (6); and (g) a system inlet temperature sensor (38) disposed on said receiving end of said cold side conductor (4), wherein said receiving end of said cold side conductor (4) is configured to be connected to a cold water supply manifold, said exit end of said hot side conductor (6) is configured to be connected to a hot water supply manifold (26), said pump (12) is configured to generate a flow through each of said at least one heat exchanger (8) and whereby when a temperature indicated by said inlet temperature sensor (28) exceeds a temperature indicated by said system inlet temperature sensor (38), said flow valve (32) of said at least one heat exchanger (8) is configured to be restricted to enable an increased flow from said receiving end of said cold side conductor (4) to said exit end of said hot side conductor (6) through said bypass conductor (10) to temper a flow exiting said exit end of said hot side conductor (6) and when a temperature indicated by said system outlet temperature sensor (40) falls below a temperature indicated by said inlet temperature sensor (28), said flow valve (32) of said at least one heat exchanger (8) is configured to be enlarged to enable an increased flow from said cold side conductor (4) to said exit end of said hot side conductor (6) through said at least one heat exchanger (8) to increase the temperature of the flow exiting said exit end of said hot side conductor (6).

8. The low pressure drop water heating system (2) of claim 7, wherein said bypass conductor (10) comprises an exhaust (14) disposed at said second end of said bypass conductor (10), said exhaust (14) comprising at least one opening configured for allowing effluents of said at least one opening (16) to be pointed in a direction from said exit end of said hot side conductor (6) to said closed end of said hot side conductor (6), said at least one opening of said exhaust causes said effluents of said at least one opening (16) to be mixed with a flow within said hot side conductor (6) to form the flow exiting said exit end of said hot side conductor (6).

9. The low pressure drop water heating system (2) of claim 8, wherein said hot side conductor (6) further comprises an upper half and a lower half and said exhaust (14) is configured to be disposed on said upper half of said hot side conductor (6) within said hot side conductor (6).

10. The low pressure drop water heating system (2) of claim 8, wherein said hot side conductor (6) further comprises an upper half and a lower half and said exhaust (14)

is an inverted J-shaped exhaust having at least one opening disposed on said upper half of said hot side conductor (6) within said hot side conductor (6).

11. The low pressure drop water heating system (2) of claim 7, wherein said bypass conductor (10) comprises an exhaust (14) disposed within said hot side conductor (6), said exhaust (14) comprising at least one opening configured for allowing effluents of said at least one opening to be pointed in a direction perpendicular to a direction from said exit end of said hot side conductor (6) to said closed end of said hot side conductor (6).

12. The low pressure drop water heating system (2) of claim 7, further comprising a valve (56) disposed within said bypass conductor (10).

13. A low pressure drop water heating system (2) comprising:

(a) a cold side conductor (4) comprising a receiving end and a closed end;

(b) a hot side conductor (6) comprising an exit end, a closed end, an upper half and a lower half;

(c) a pump (12);

(d) a bypass conductor (10) comprising a first end, a second end and an exhaust (14) configured to be disposed on said upper half of said hot side conductor (6) within said hot side conductor (6), wherein said first end of said bypass conductor (10) is adapted to said receiving end of said cold side conductor (4) and said second end of said bypass conductor (10) is adapted to said exit end of said hot side conductor (6);

(e) at least one heat exchanger (8) comprising a flow valve (32), an inlet temperature sensor (28) disposed on an inlet of said at least one heat exchanger (8) and an outlet temperature sensor (30) disposed on an outlet of said at least one heat exchanger (8);

(f) a system outlet temperature sensor (40) disposed on said exit end of said hot side conductor (6); and (g) a system inlet temperature sensor (38) disposed on said receiving end of said cold side conductor (4), wherein said receiving end of said cold side conductor (4) is configured to be connected to a cold water supply manifold, said exit end of said hot side conductor (6) is configured to be connected to a hot water supply manifold (26), said pump (12) is configured to generate a flow through each of said at least one heat exchanger (8) and whereby when a temperature indicated by said inlet temperature sensor (28) exceeds a temperature indicated by said system inlet temperature sensor (38), said flow valve (32) of said at least one heat exchanger (8) is configured to be restricted to enable an increased flow from said receiving end of said cold side conductor (4) to said exit end of said hot side conductor (6) through said bypass conductor (10) to temper a flow exiting said exit end of said hot side conductor (6) and when a temperature indicated by said system outlet temperature sensor (40) falls below a temperature indicated by said inlet temperature sensor (28), said flow valve (32) of said at least one heat exchanger (8) is configured to be enlarged to enable an increased flow from said cold side conductor (4) to said exit end of said hot side conductor (6) through said at least one heat exchanger (8) to increase the temperature of the flow exiting said exit end of said hot side conductor (6).

14. The low pressure drop water heating system (2) of claim 13, wherein said exhaust (14) comprises at least one opening (16) configured for allowing effluents of said at least one opening (16) to be pointed in a direction from said exit end of said hot side conductor (6) to said closed end of said hot side conductor (6), said at least one opening of said exhaust causes said effluents of said at least one opening (16) to be mixed with a flow within said hot side conductor (6) to form the flow exiting said exit end of said hot side conductor (6).

15. The low pressure drop water heating system (2) of claim 13, wherein said exhaust comprises at least one opening configured for allowing effluents of said at least opening to be pointed in a direction perpendicular to a direction from said exit end of said hot side conductor (6) to said closed end of said hot side conductor (6).

16. The low pressure drop water heating system (2) of claim 13, wherein said hot side conductor (6) further comprises an upper half and a lower half and said exhaust (14) is an inverted J-shaped exhaust having at least one opening disposed on said upper half of said hot side conductor (6) within said hot side conductor (6).

17. The low pressure drop water heating system (2) of claim 13, wherein said hot side conductor (6) further comprises a volume of from about 0.5 to about 2 gallons and said bypass conductor (10) comprises a tubing of size of from about 0.5 to about 1.5 inches.

18. The low pressure drop water heating system (2) of claim 13, further comprising a valve (56) disposed within said bypass conductor (10).

* * * * *